US007177551B2

(12) United States Patent
Eom et al.

(10) Patent No.: US 7,177,551 B2
(45) Date of Patent: Feb. 13, 2007

(54) APPARATUS FOR MANAGING CONSUMABLES OF IMAGE FORMING APPARATUS

(75) Inventors: Yoon-seop Eom, Suwon-si (KR); Seung-deog An, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 10/934,371

(22) Filed: Sep. 7, 2004

(65) Prior Publication Data

US 2005/0095020 A1 May 5, 2005

(30) Foreign Application Priority Data

Oct. 31, 2003 (KR) ..... 10-2003-0076730

(51) Int. Cl.
*G03G 15/00* (2006.01)

(52) U.S. Cl. ..... 399/12; 399/24; 399/26; 399/27; 399/31

(58) Field of Classification Search ..... 399/12, 399/24–28, 31
See application file for complete search history.

(56) References Cited

U.S. PATENT DOCUMENTS 6,631,248 B2 * 10/2003 Serizawa ..... 399/27
7,062,181 B2 * 6/2006 Buchheit ..... 399/24

FOREIGN PATENT DOCUMENTS

| | | |
|---|---|---|
| JP | 07-064452 | 3/1995 |
| JP | 2000-056638 | 2/2000 |
| JP | 2000-158665 | 6/2000 |
| JP | 2002-040904 | 2/2002 |
| JP | 2002-072830 | 3/2002 |
| JP | 2002-341705 | 11/2002 |
| JP | 2003-312018 | 11/2003 |
| KR | 96-0018783 | 6/1996 |
| KR | 1999-0088509 | 12/1999 |
| KR | 2000-0008624 | 2/2000 |
| KR | 2001-0049000 | 6/2001 |
| KR | 2001-0067327 | 7/2001 |
| KR | 2003-0017252 | 3/2003 |
| KR | 2003-0062270 | 7/2003 |

* cited by examiner

*Primary Examiner*—William J. Royer
(74) *Attorney, Agent, or Firm*—Roylance, Abrams, Berdo & Goodman, L.L.P.

(57) ABSTRACT

The present invention relates to an apparatus for managing consumables of an image forming apparatus widely used in printers, multi-function printers, and so on. The apparatus of the present invention includes memory devices provided in the consumables for writing and reading data related to the consumables and for managing the consumables. As such the present invention uses less signal lines for a development cartridge, informs a user to refill the consumables, and is less sensitive to noise due to the digital management of consumables.

8 Claims, 10 Drawing Sheets

Mapping Address

| A2 | A1 | A0 | Cartridge Name |
|---|---|---|---|
| 0 | 0 | NC | Yellow Cartridge |
| 0 | 1 | NC | Magenta Cartridge |
| 1 | 0 | NC | Cyan Cartridge |
| 1 | 1 | NC | Black Cartridge |

| A2 | A1 | A0 | Unit Name |
|---|---|---|---|
| 0 | 0 | NC | ITB Unit |
| 0 | 1 | NC | Reserve |
| 1 | 0 | NC | Reserve |
| 1 | 1 | NC | Reserve |

APPARATUS FOR MANAGING CONSUMABLES OF IMAGE FORMING APPARATUS

CROSS REFERENCE TO RELATED APPLICATIONS

This application claims the benefit under 35 U.S.C. §119 (a) of Korean Patent Application No. 2003-76730, filed in the Korean Intellectual Property Office on Oct. 31, 2003, the entire disclosure of which is incorporated herein by reference.

BACKGROUND OF THE INVENTION

1. Field of the Invention

The present invention relates to an apparatus for managing consumables of an image forming apparatus which are widely used in printers, such as multi-function printers (MFP). More particularly, the present invention relates to an apparatus using a memory for managing consumables of an image forming apparatus.

2. Description of the Related Art

Generally, a facsimile machine, a printer, a copier, and an MFP which combines the functions of a printer, scanner, copier or facsimile machine include an image forming apparatus.

FIG. 1 shows a schematic block diagram of a conventional image forming apparatus and FIG. 2 shows a schematic view of an engine device of the apparatus shown in FIG. 1.

Referring to FIG. 1, the conventional image forming apparatus includes a control unit 10 controlling an overall operation of the apparatus, an interface unit 20 for connecting a computer and the apparatus to receive printing data from the computer, a storage unit 30 for storing a variety of control programs necessary for driving the apparatus and data generated by executing the control programs, an engine device 50 for carrying out a print process, an engine control unit 40 for driving the engine device 50 according to a control of the control unit 10, a high voltage power supply 80 for applying a predetermined voltage to each roller of the engine device 50 according to a control of the control unit 10, and a sensor unit 90 for detecting a printing error like a paper jam or shortage of paper. The engine device 50 shown in FIG. 2 is provided with a charge roller 51, an organic photoconduction cartridge (OPC) 52, a laser scan unit (LSU) 53, a development roller 54, a feed roller 55, a transfer roller 56 and a fusing unit 57, for printing image data on the paper.

The development roller 54 and the transfer roller 56 as shown in FIG. 2 are respectively connected with color development cartridges YC, MC, CC, BC for color prints and an image transfer belt (ITB) as shown in FIG. 3.

Printing procedures of the engine device 50 having the structure of FIG. 2 are typically as follows. The high voltage power supply unit 80 applies voltages to each roller 51, 54, 55, 56, 57 of the engine device 50 according to a control of the control unit 10. Herein, the high voltage power supply (HVPS) 80 generally applies a charge voltage of −1.4 kV to the charge roller 51, a transfer voltage of +2.0 kV to the transfer roller 56, a development voltage of 300V to the development roller 54, a feed voltage of 500V to the feed roller 55. Therefore, the charge roller 51 charged by the high voltage and engaged with the OPC 52 rotates to uniformly charge the photoconductor formed on an outer circumference of the OPC 52. Herein, the LSU 53 receives a control signal from the control unit 10, the control signal allowing an image light corresponding to an image data inputted from control unit 10 to be scanned onto the OPC 52. Accordingly, a laser diode (LD) provided in the LSU 53 is turned on and projects the image light corresponding to the received control signal to the OPC 52. As a result, an electrostatic latent image to be printed, charged by the image light of the LSU 53, is formed on the surface of the OPC 52. Meanwhile, a potential difference is generated between the feed roller 55 to which the high voltage is applied and the development roller 54 to which the voltage lower than that of the feed roller 55 is applied. Accordingly, a toner charged negatively moves to the development roller 54 from the feed roller 55 and is coated on the electrostatic latent image formed on the surface of the OPC 52 to form a toner image. The transfer roller 56 to which the high voltage from HVPS 80 is applied transfers the toner image formed on the electrostatic latent image of the OPC 52 to a paper. The toner image transferred on the paper is fused on the paper by high temperature and high pressure of the fusing unit 57, thereby ending a printing process.

As described above, a plurality of consumables such as development cartridges YC, MC, CC, BC, the ITB unit, the OPC unit and so on such as shown in FIG. 3, are needed for the image forming apparatus to print an image, particularly a color image. In FIG. 3, YC indicates the development cartridge for yellow color, MC indicates the development cartridge for magenta color, CC indicates the development cartridge for cyan color, and BC indicates the development cartridge for black color.

As shown in FIG. 3, key resistances Ry, Rm, Rc, Rb, Ri, Ro provided in the conventional consumables allow the control unit 10 of the image forming apparatus to detect the amounts of colors in the consumables for refilling or replacing the consumables.

The key resistances provided in the respective consumables are respectively connected to pull-up resistances R1 provided in a main board 1 of the image forming apparatus as shown in the FIG. 3, and are also connected to respective ports of the control unit 10. The other terminals of the respective key resistances are grounded, and the other terminals of the respective pull-up resistances are supplied with a power supply voltage Vcc. As shown in FIG. 4, the key resistances vary according to the time of use or consumption of contents (such as ink or toner) of the consumables. The voltage applied to control unit 10 also varies according to the variation of the key resistances. The control unit 10 functions to perceive the consumables, and/or to prevent refill of consumables, and/or to detect the consumables' life span, and so on, through the variation of key resistance.

The conventional apparatus for managing consumables of an image forming apparatus with key resistances provided in the consumables has several disadvantages.

First, the control unit of the image forming apparatus needs as many key resistance sensing ports as the number of consumables to individually detect the key resistances provided in the consumables. For example, as shown in FIG. 3, the control unit 10 of the image forming apparatus needs at least six ports for detecting the individual key resistances of four development cartridges, the ITB, and the OPC. That is, the control unit of the conventional image forming apparatus needs more ports for detecting the key resistance as the number of consumables increases.

Second, a control program of the control unit 10 to individually control the respective ports corresponding to the key resistance of the consumables is very complicated.

Third, signal connection lines and an electrical wire harness to respectively connect the key resistances of the consumables to the ports of the control unit have a complicated structure. Therefore the price of the apparatus increases.

Fourth, it is hard to substantially detect the refill of contents (such as ink or toner of the development cartridge) of the consumables with the key resistances. Therefore, the refill of contents is not practically prevented.

Fifth, if there are many OEM venders manufacturing the consumables, it is hard to identify the OEM venders.

SUMMARY OF THE INVENTION

The present invention provides an apparatus using a memory for managing consumables of an image forming apparatus, whereby a hardware structure and a software structure of the image forming apparatus are simplified, and low cost and high reliability thereof can be achieved.

According to an aspect of the present invention, there is provided an apparatus for managing consumables of an image forming apparatus, the managing apparatus including memory means provided in the consumables to write and read data related to the consumables, the memory means preferably including a clock terminal which receives clock signals of the image forming apparatus; a data terminal which is used for writing or reading data transmitted between the image forming apparatus and the memory; and a ground terminal, wherein, if there are two or more consumables, the same kind of terminals can be connected to each other.

The consumables can comprise a development cartridge, an ITB unit, or an OPC. The development cartridge may comprise any color development cartridge, including a yellow development cartridge, a cyan development cartridge, a magenta development cartridge, or a black development cartridge.

The memory means may be supplied with power through the clock signals applied to the clock terminal or the data signals applied to the data terminal from the image forming apparatus.

The memory means provided in the development cartridge may store data regarding quantity of development toner. Also, the data being stored in the memory of the development cartridge may preferably include the development cartridge ID, a capacity of the development cartridge, a manufacturer, a serial number, a manufacturing date, and the color of the development toner.

The memory means can also preferably store data having address information to identify the consumables.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numbers are used to depict like features and structures.

DETAILED DESCRIPTION OF THE EXEMPLARY EMBODIMENTS

Figure 1:
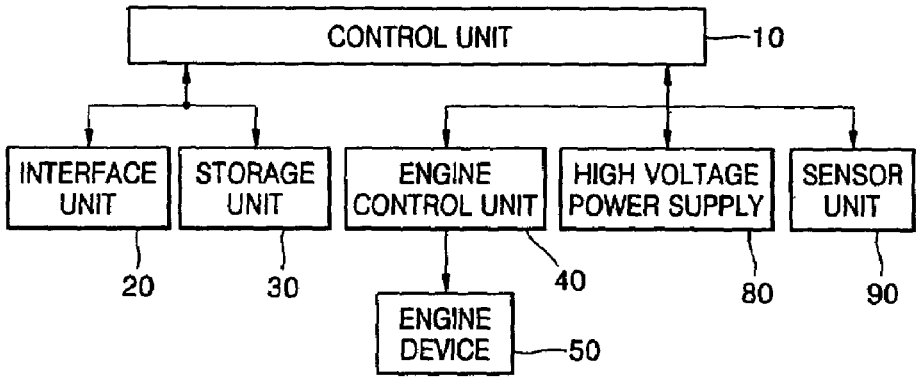
FIG. 1 (PRIOR ART)
FIG. 1 is a schematic block diagram illustrating a conventional image forming apparatus.
Figure 2:
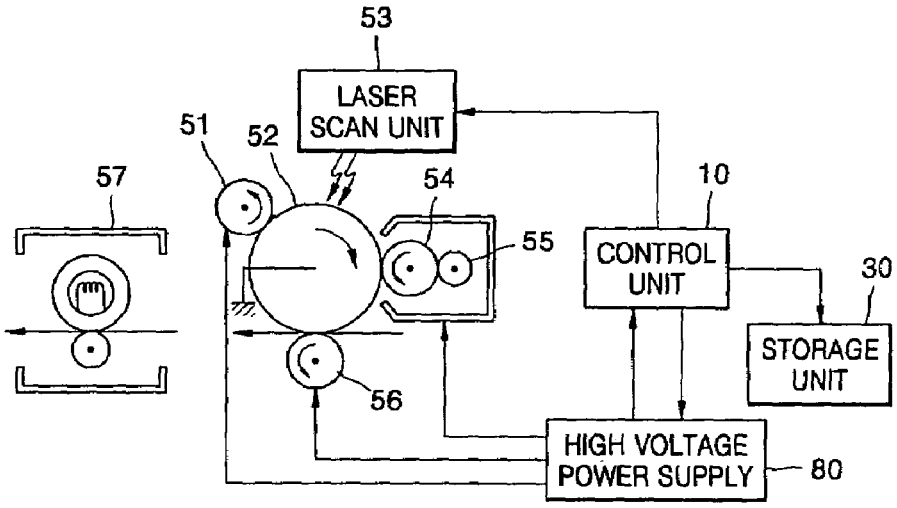
FIG. 2 (PRIOR ART)
FIG. 2 is a view schematically illustrating a construction of an engine device of the conventional image forming apparatus of FIG. 1.
Figure 3:
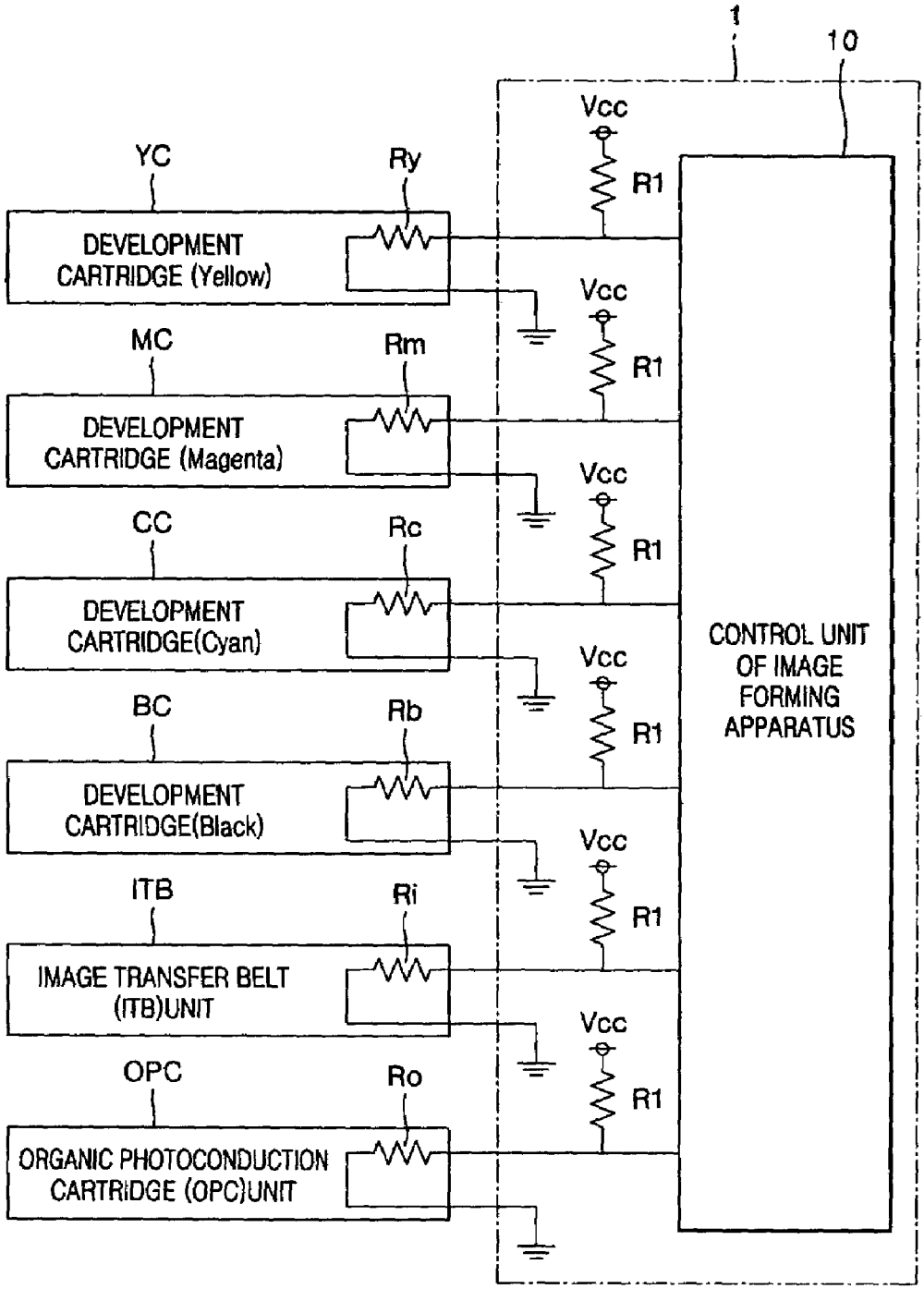
FIG. 3 (PRIOR ART)
FIG. 3 is a view illustrating a conventional apparatus for managing consumables of an image forming apparatus.
Figure 4:
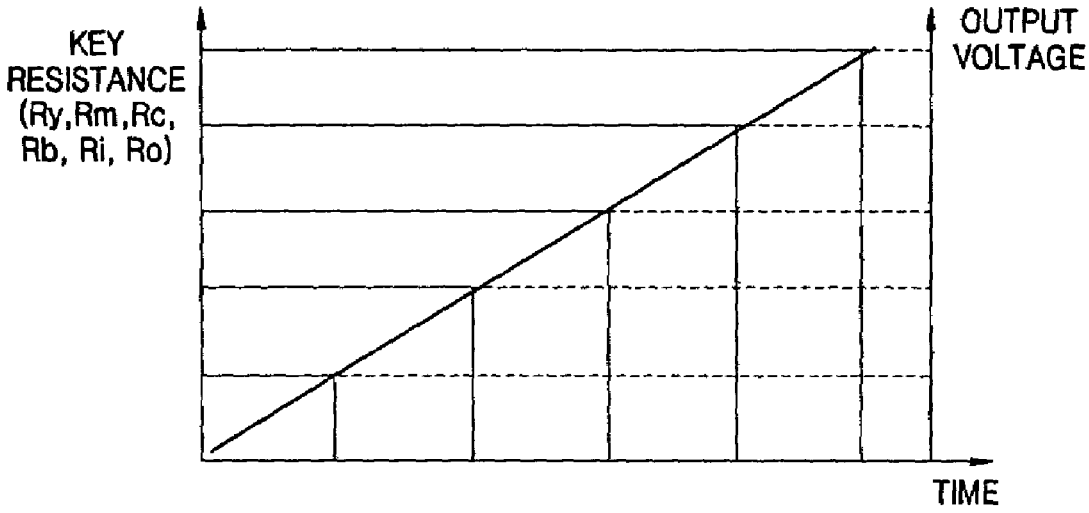
FIG. 4 (PRIOR ART)
FIG. 4 is a graph illustrating a variation of key resistances used in the conventional apparatus of FIG. 3.

Embodiments of the present invention will now be described more fully with reference to the accompanying drawings. It should be understood, however, that the invention may be embodied in many different forms and should not be construed as being limited to the embodiments set forth herein. Rather, these exemplary embodiments are provided so that this disclosure will be thorough and complete, and will fully convey the concept of the invention to those skilled in the art. In the drawings, the thicknesses of layers and regions are exaggerated for clarity. The technical terms in the description are defined according to the function of the present invention and can be changed in accordance with usual practice or the intent of a user or operator.

Figure 5:
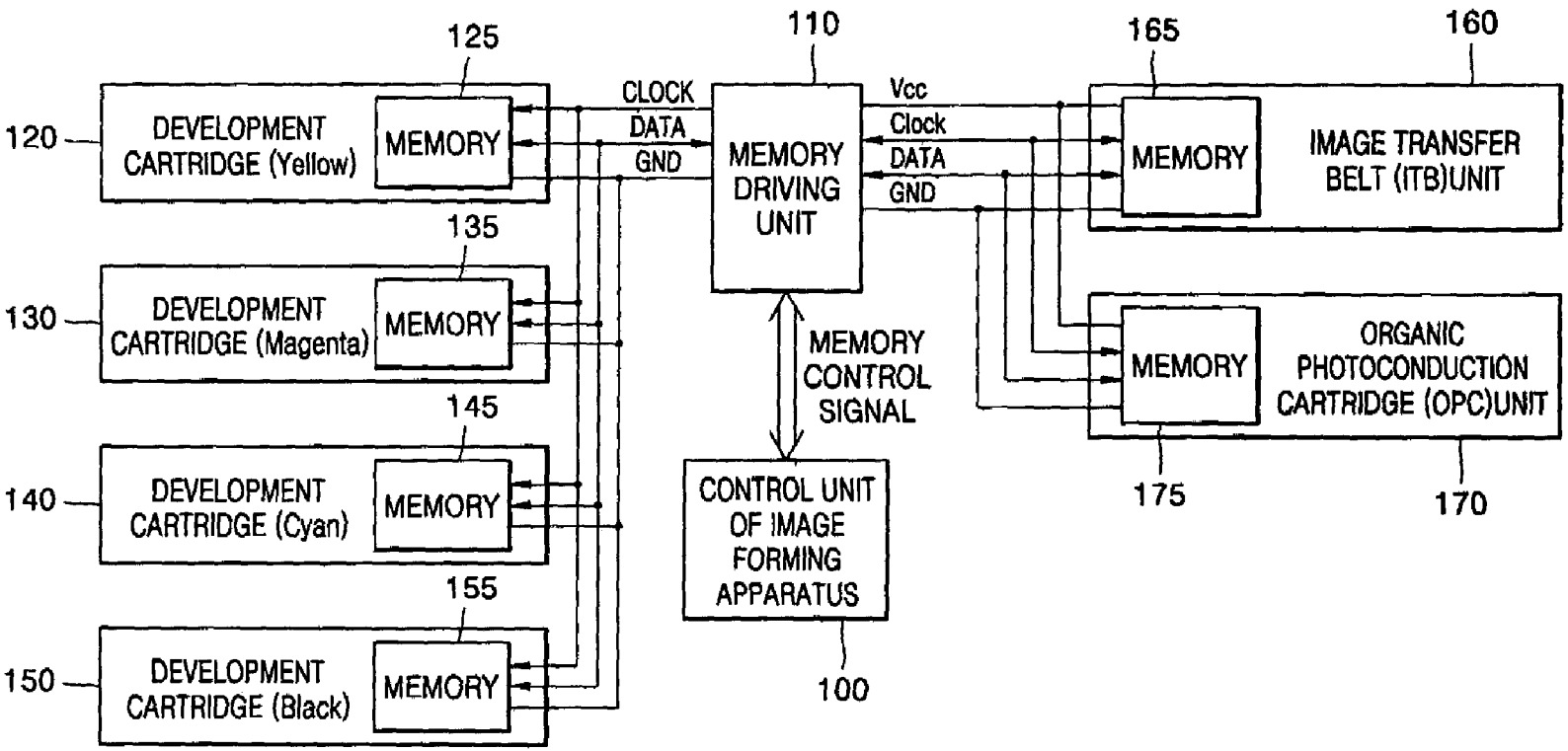
FIG. 5 is a block diagram illustrating an apparatus using memory for managing consumables of an image forming apparatus according to an embodiment of the present invention.
Figure 6:
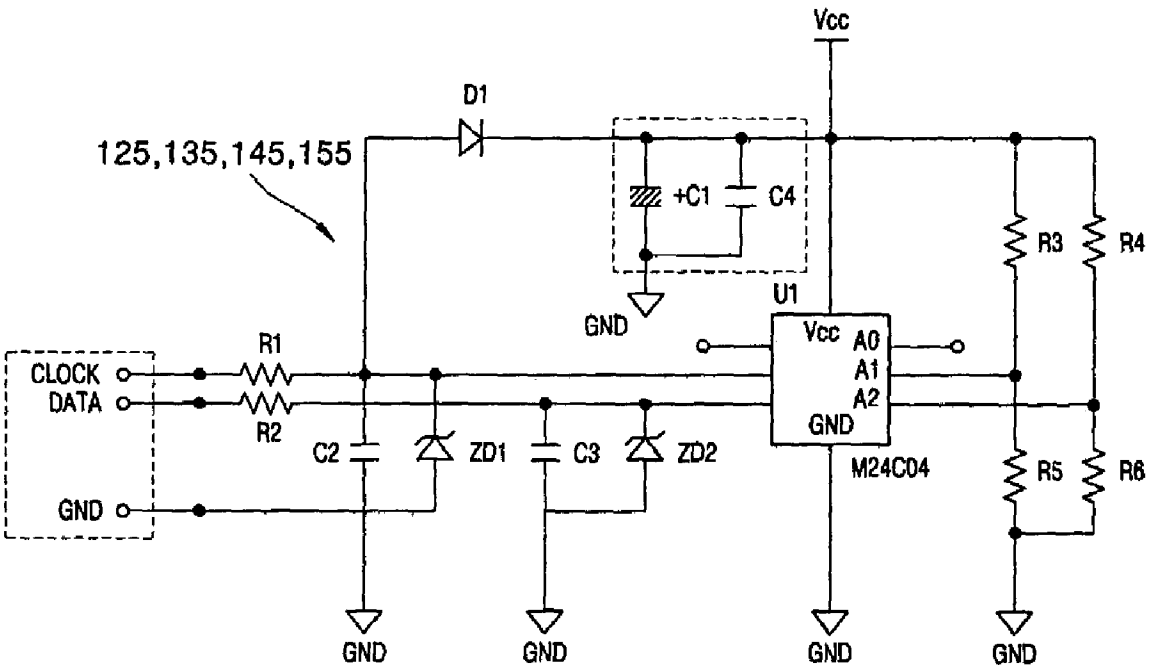
FIG. 6 is a detailed circuit diagram of an exemplary memory unit provided in a development cartridge according to an embodiment of the present invention.
Figure 7:
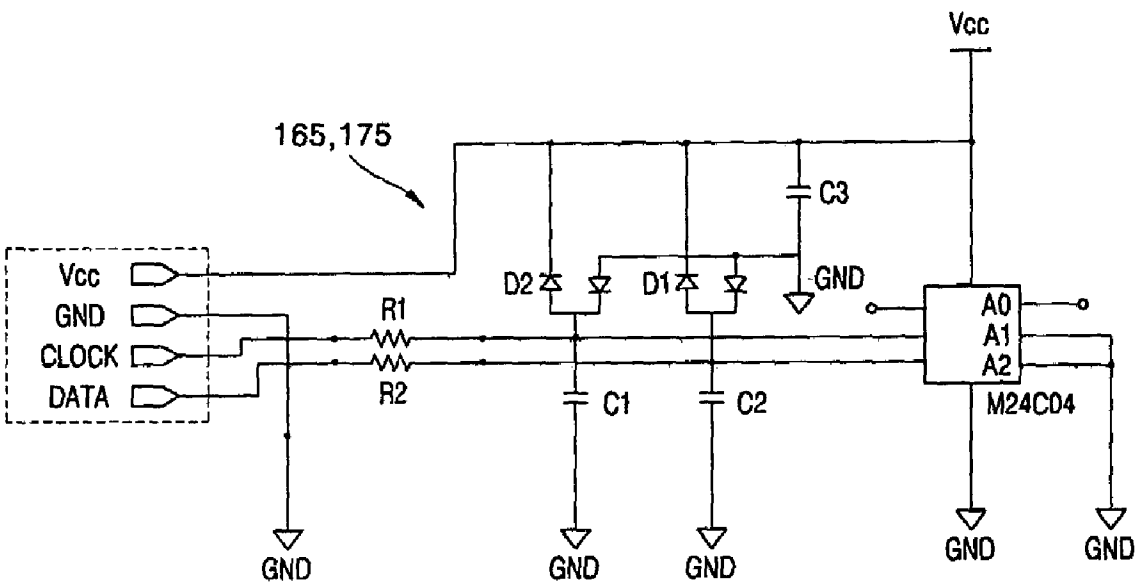
FIG. 7 is a detailed circuit diagram of an exemplary memory unit provided in an image transfer belt unit according to an embodiment of the present invention.

Referring to FIGS. 5, 6, and 7, in an apparatus for managing consumables of an image forming apparatus according to an embodiment of the present invention, the consumables, such as development cartridges 120, 130, 140, 150, ITB 160, and OPC unit 170 are respectively provided with memories 125, 135, 145, 155 165, 175. The memories 125, 135, 145, 155 provided in the development cartridges respectively have a clock terminal, a data terminal and a ground terminal, and these terminals are connected to a memory driving unit 110 of the image forming apparatus as shown in FIGS. 5 and 6. The same kind of terminals of the memories 125, 135, 145, 155 provided in development cartridges are connected to one another and connected to the memory driving unit 110. Therefore the number of connection terminals of the memory driving unit for connecting with the memories does not change regardless of the number of development cartridges.

Referring to FIG. 6, the memories 125, 135, 145, 155 of an embodiment of the present invention are supplied with necessary power through clock terminals. In other words, clock signals of the memory driving unit 110 also denote power inputs of the memories 125, 135, 145, and 155 as well because pulses of the clock signals applied to memories 125, 135, 145, and 155 are preferably smoothed by a charge pumping circuit having smoothing capacitor C1 and C2. A diode D1 is used for preventing the clock signals from being affected by a voltage of the charge pumping circuit, which is obvious to those skilled in the art.

Figure 10:
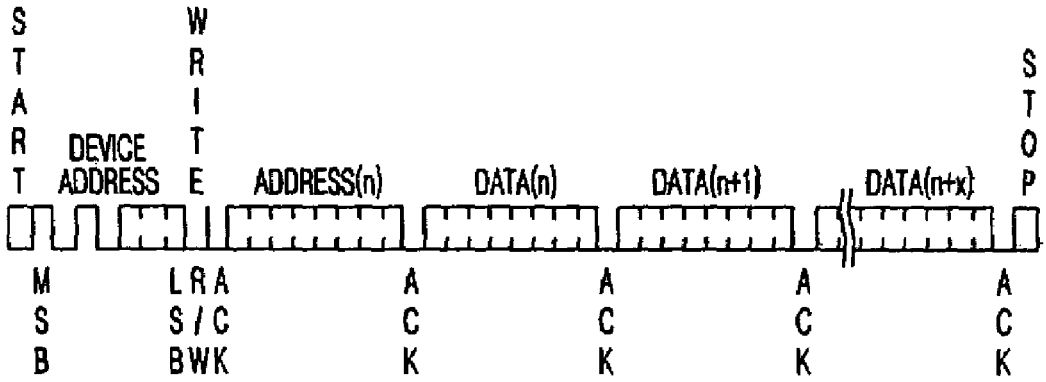
FIG. 10 is a view illustrating a data structure for an embodiment of the present invention.

Therefore, when the clock signals of memory driving unit 110 are applied to the memories 125, 135, 145, and 155, the memories 125, 135, 145, and 155 can exchange data with the memory driving unit 110. Tn other words, data can be read from or written to the memories. Data exchanged between the memories 125, 135, 145, and 155 and the memory driving unit 110 basically include data regarding the quantity of development toner in the development cartridge, the development cartridge ID, the development cartridge capacity, manufacturer, serial number, manufacturing date and color of the development toner, and so on. Further, the data may include address information as shown in FIG. 10 to recognize the consumables. A device address as shown in FIG. 10 is for recognizing the development cartridge 125, 135, 145, 155, ITB unit 160, or OPC unit 170, and an address (n) is for identifying memories. A data area is for storing practical information to manage consumables.

The memories 125, 135, 145, and 155 are supplied with power via the clock signals of the memory driving unit 110 according to the embodiment shown in FIG. 5 and 6. However, the memories 125, 135, 145, and 155 can alternately receive power through the data terminal, or the memories 125, 135, 145, and 155 can receive power through power terminals Vcc separately provided in the memories like the ITB unit 160 or the OPC unit 170 as shown in the right side of FIG. 5.

Referring to FIGS. 5 and 7, the memories 165, 175 provided in the ITB unit 160 and OPC unit 170 include a power terminal Vcc, a clock terminal, a data terminal and a ground terminal, and these terminals are connected to the memory driving unit 110 of the image forming apparatus. The same kind of terminals of the memories 165 and 175 provided in the ITB unit 160 and the OPC unit 170 are connected to each other and then connected to the memory driving unit 110. Therefore the number of terminals of the memory driving unit 110 for connecting with the memories does not change regardless of the number of consumables, thereby simplifying the hardware structure and software program of the apparatus according to embodiments of the present invention.

Referring to FIGS. 5 and 7, the memories 165 and 175 are supplied with power through the power terminals Vcc. However, they can alternately be supplied with power through the clock terminals or the data terminal without the need for the power terminals like in the memories 125, 135, 145, and 155 as shown in FIG. 6.

As described above, the memories 165 and 175 are supplied with power and can exchange data with the memory driving unit 110. Data exchanged between the memories 165 and 175 and the memory driving unit 110 typically include a counter used for information related to a life span of the ITB unit 160 and the OPC unit 170, the unit ID, the unit's counter capacity, manufacturer, serial number, manufacturing date, and so on. Further, the data can preferably include address information as shown in FIG. 10 to recognize the JTB unit 160 and the OPC unit 170.

Figure 8:
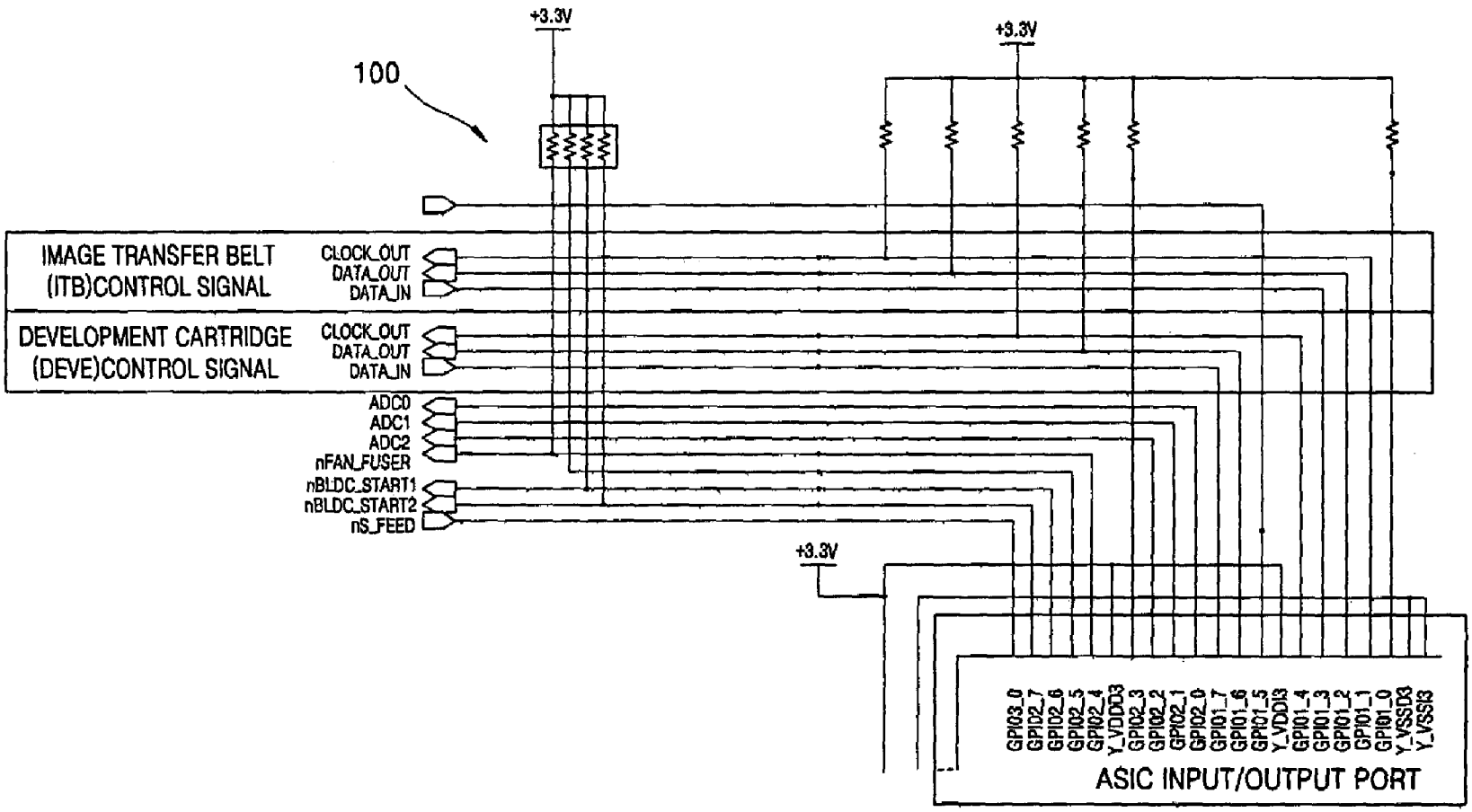
FIG. 8 is a detailed circuit diagram of an image forming apparatus according to an embodiment of the present invention.

FIG. 8 is a detailed circuit diagram of the a control unit 100 of the image forming apparatus according to an embodiment of the present invention. The control unit 100 supplies the memory driving unit 110 with the clock signals and exchanges data related to the development cartridge and ITB 160 with the memory driving unit 110. The reference numerals and symbols as shown in FIG. 8 except for those related to control signals for the ITB and the development cartridge are just for reference and are not related to the present invention, so descriptions thereof are omitted.

Figure 9A:
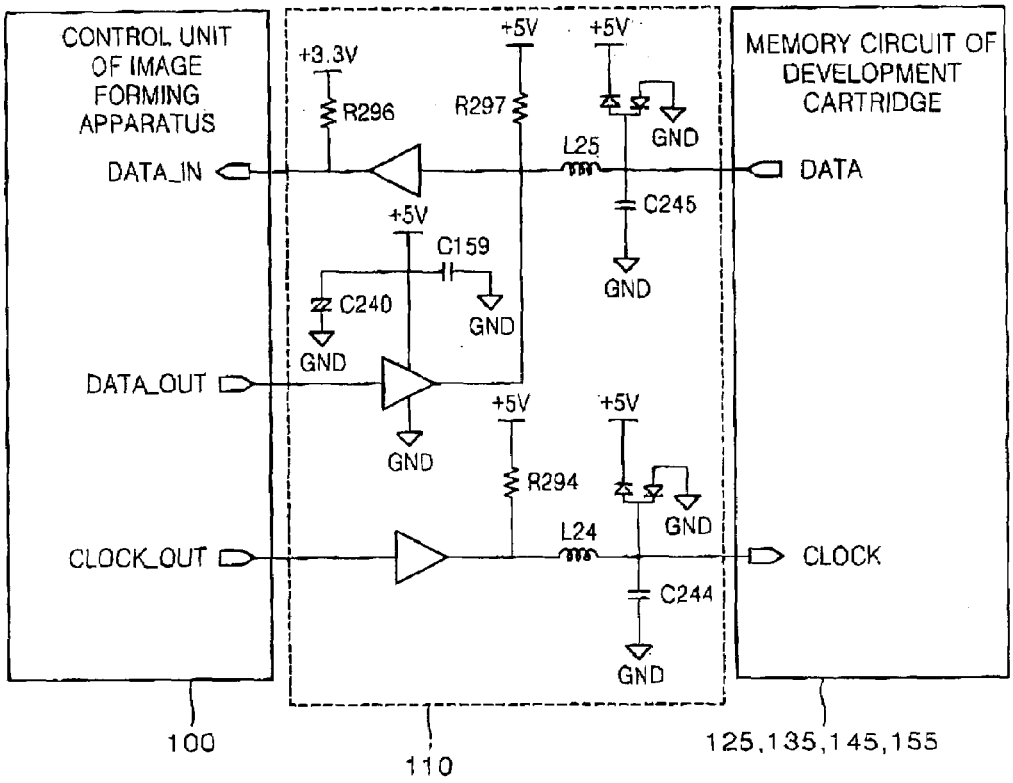
FIGS. 9A and 9B are detailed circuit diagrams of an exemplary driving unit according to an embodiment of the present invention.
Figure 9B:
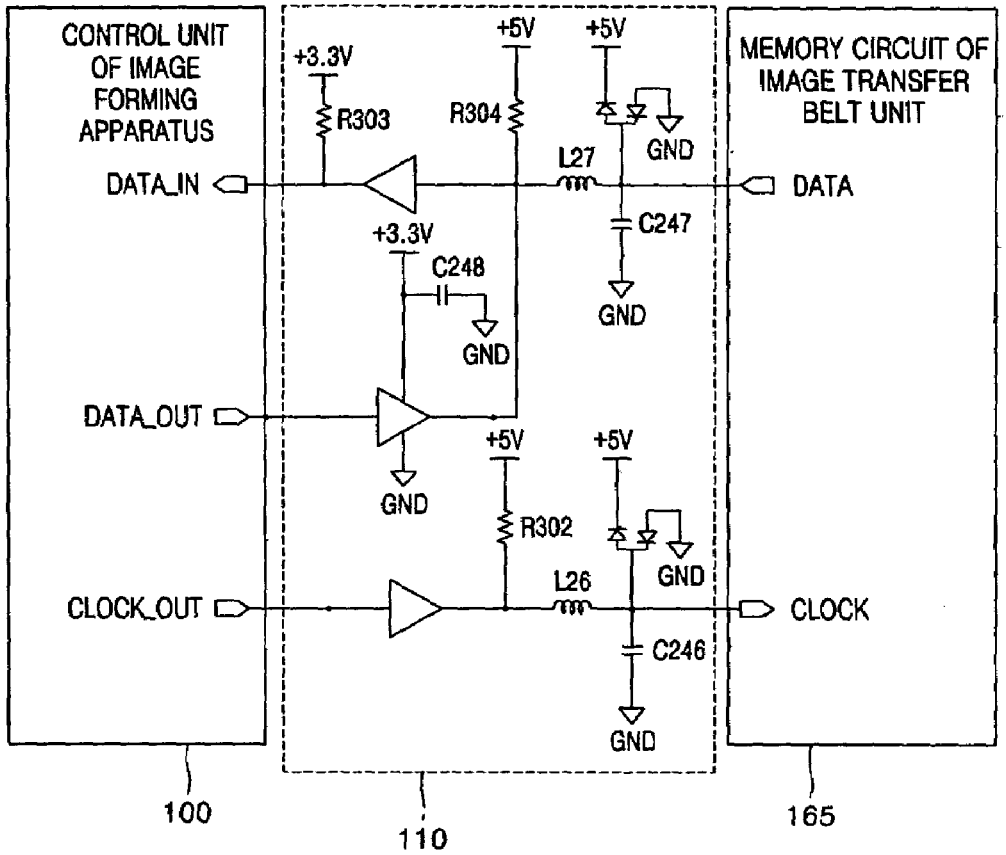

FIGS. 9A and 9B are detailed circuit diagrams of the memory driving unit 110 according to an embodiment of the present invention. The memory driving unit 110 is related to the memories 125, 135, 145, and 155 of the development cartridges and the memory 165 of the ITB unit. Referring to FIGS. 9A and 9B, the memory driving unit 110 provided between the control unit 100 of the image forming apparatus and the memories 125, 135, 145, 155, and 165 transfers the clock signals of the control unit 100 to the memories 125, 135, 145, 155, and 165 and relays data for managing the consumables.

The memories 125, 135, 145, 155, 165, and 175 can be EEPROM or ASIC. Although the control unit 100 and the memory driving unit 110 can preferably be contructed as an ASIC, embodiments of the present invention are not limited to ASIC design. As described above, the apparatus using a memory for managing consumables of an image forming apparatus according to an embodiment of the present invention has a simple hardware structure and software program, thereby improving reliability and reducing manufacturing cost. The apparatus uses less signal lines for the development cartridges, is less sensitive to noise, and surely informs a user to refill consumables.

While the present invention has been particularly shown and described with reference to exemplary embodiments thereof, it will be understood by those of ordinary skill in the art that various changes in form and details may be made therein without departing from the spirit and scope of the present invention, as defined by the following claims.

What is claimed is:

1. An apparatus for managing consumables of an image forming apparatus, the managing apparatus comprising:

a memory device which is provided in the consumables to write and read data related to the consumables, wherein the memory device includes:

a clock terminal which receives clock signals from the image forming apparatus;

a data terminal which is used for writing or reading data transmitted between the image forming apparatus and the memory device; and a ground terminal, wherein, if there are two or more consumables, the same kind of terminals are connected to each other.

2. The apparatus of claim 1, wherein the consumables comprise a development cartridge, an image transfer belt unit, and an organic photoconduction cartridge, and the development cartridge comprises a yellow development cartridge, a cyan development cartridge, a magenta development cartridge, and a black development cartridge.

3. The apparatus of claim 1, wherein the memory device further comprises a power input terminal which receives a power from the image forming apparatus.

4. The apparatus of claim 1, wherein the memory device is supplied with power through the clock signals applied to the clock terminal from the image forming apparatus.

5. The apparatus of claim 1, wherein the memory device is supplied with power through the data signals applied to the data terminal from the image forming apparatus.

6. The apparatus of claim 2, wherein the memory device provided in the development cartridge stores data regarding the quantity of development toner.

7. The apparatus of claim 2, wherein the memory device of the development cartridge stores data information including a development cartridge ID, a capacity of the development cartridge, a manufacturer, a serial number, a manufacturing date, and color of the development toner.

8. The apparatus of claim 2, wherein the memory device stores data information including address information to identify the corresponding consumables.

* * * * *